US005397139A

United States Patent [19]

Simpson

[11] Patent Number: 5,397,139

[45] Date of Patent: Mar. 14, 1995

[54] ALL TERRAIN CREEPER

[76] Inventor: Charles E. Simpson, 36505 W. Florida, Sp. 135, Hemet, Calif. 92545

[21] Appl. No.: 295,008

[22] Filed: Aug. 24, 1994

[51] Int. Cl.[6] ..... B25H 5/00

[52] U.S. Cl. ..... 280/32.6; 301/40.2; 301/41.1

[58] Field of Search ..... 280/32.6; 301/5.1, 40.2, 301/41.1, 43

[56] References Cited

U.S. PATENT DOCUMENTS 1,649,721 11/1927 Mohler .
1,823,526 9/1931 Breeden .
2,432,107 12/1947 Williams ..... 301/5.1
4,185,846 1/1980 Black .
4,792,147 12/1988 Wissing .
4,875,694 10/1989 Hamrick .
4,909,524 3/1990 Paine .
5,213,350 5/1993 Hermanson .

*Primary Examiner*—Mitchell J. Hill
*Attorney, Agent, or Firm*—Sheldon & Mak

[57] ABSTRACT

Disclosed is a creeper for movably supporting a reclining worker in confined space on a variety of ground surfaces. The creeper includes a body platform; at least three wheels rotatably mounted relative to the platform for rolling ground contact whereby the platform is movable by the worker above the ground surface. Each wheel has a circumferential outer rib, preferably having an outside diameter not less than approximately 5 inches and a rib width not greater than approximately 1.5 inches for smooth rolling contact with the ground surface when the ground surface is hard and flat; and a plurality of side ribs laterally extending on opposite sides of the outer rib, the side ribs collectively having a major diameter preferably not less than approximately 1.4 inches greater than a minor diameter of the ribs, the outside diameter being between approximately 0.1 inch and 0.6 inch greater than the major diameter. The side ribs preferably extend proximately to an outside width of the wheel that is not less than approximately 5 inches for rotating engagement with the ground surface and buoyant support thereby when the ground surface is soft and unstable, each side rib having a smooth undulating contour between the major diameter and the minor diameter. At least one pair of the wheels can be rotatably mounted on a common axis fixably located relative to the body, another pair of the wheels being movably located for permitting steerage of the creeper.

11 Claims, 2 Drawing Sheets

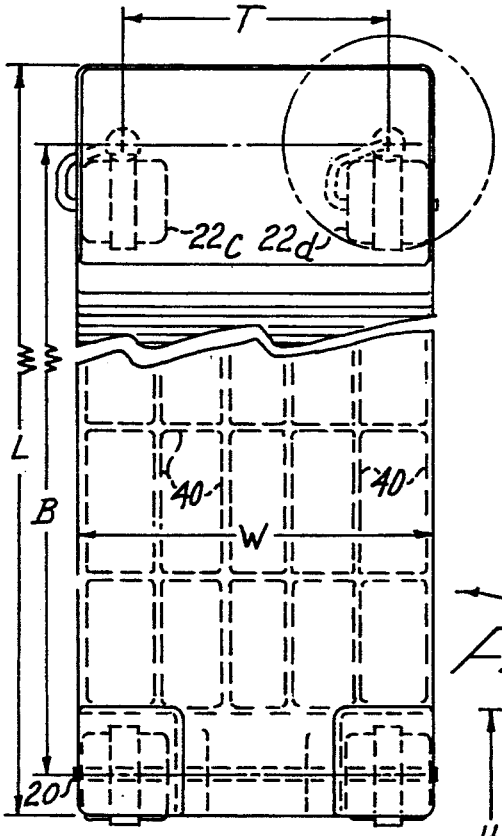
FIG. 2
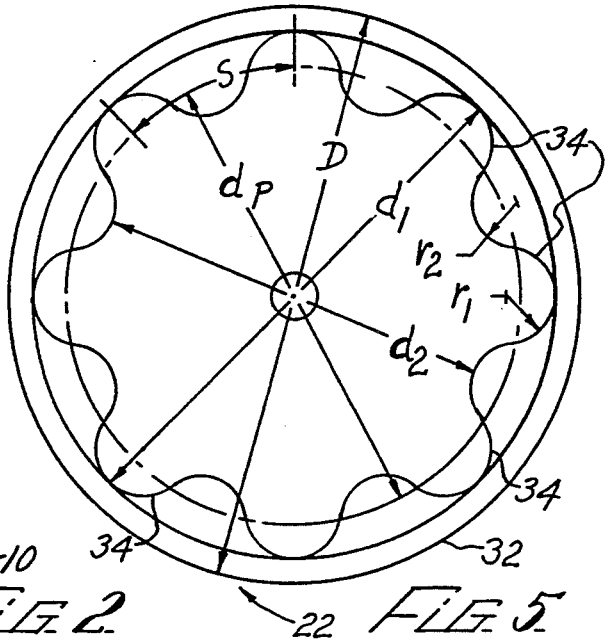
FIG. 5
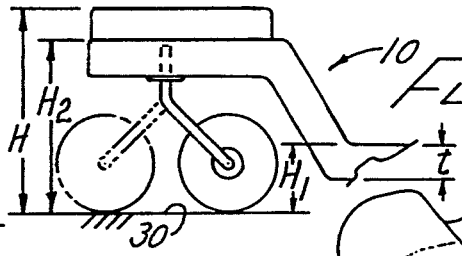
FIG. 4
FIG. 3
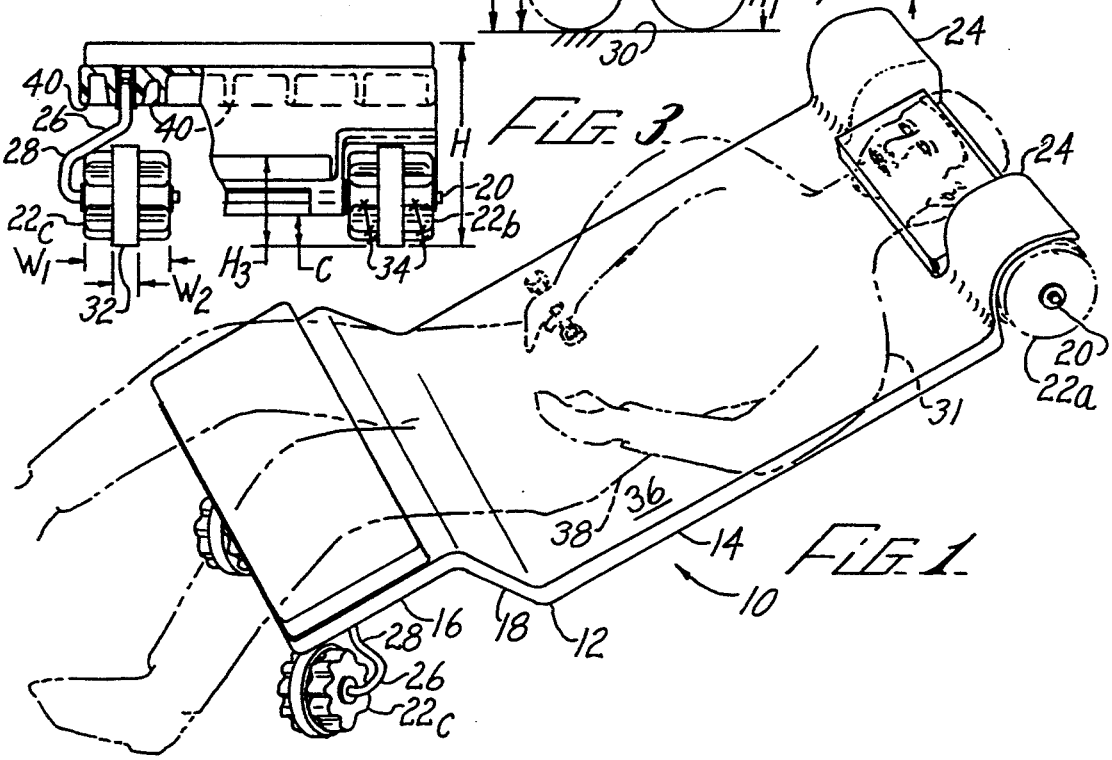
FIG. 1

ALL TERRAIN CREEPER

BACKGROUND

The present invention relates to creeper for supporting and carrying a worker in places of restricted clearance such as under vehicles, building structures and the like, where a variety of ground surface conditions may exist.

Conventional mechanics' creepers have a rectangular platform equipped with a head rest, the platform being supported at minimal ground clearance on three or four casters, or a combination of wheels and casters. While the conventional creepers are suited for pristine conditions found in many workshops and on concrete driveways, they are awkward to use or entirely impractical on uneven and unstable surfaces commonly found under mobile homes and at roadway shoulders, for example. Particularly, there is minimal ground clearance which is insufficient for avoiding grounding contact by the platform against crests of the terrain and debris commonly found thereon. Also, the wheels of prior art creepers are ineffective for support on soft terrain such as turf, gravel and sand. Instead of providing rolling support, the wheels dig in while failing to roll, the platform sinking to the ground as well, and the user must find other means of protection and/or access.

U.S. Pat. No. 4,185,846 to Black discloses a creeper having a parallel spaced pair of rigid tracks that are rollably mounted to the underside of a platform and are used by an operator for "walking" the creeper along. The creeper of Black has significant disadvantages in that movement beyond the stroke of the tracks is difficult to accomplish, and the creeper has limited turning capability, if any, particularly on hard, flat surfaces. Also, respective sides of the creeper must be lifted high enough for the tracks to extend, unloaded, over uneven terrain. Further, when the tracks bridge across rocks, crests and the like, there is reduced clearance for worker movement. Moreover, firmly anchored rocks and the like that protrude above ground can block turning movements, the turning being prevented until there has been a gross longitudinal movement past such obstacles.

Other creepers are disclosed in U.S. Pat. Nos. 1,649,721 to Mohler, 1,823,526 to Breeden, 4,875,694 to Hamrick, 4,909,524 to Paine, and 5,213,350 to Hermanson. These creepers are ineffective in that they need excessive ground clearance; they employ narrow wheels which have little float or traction in soft turf; they require padding for operator protection from sharp structural protrusions; they are useful only on hard or smooth surfaces; and/or they are not effective in hard or rocky soil.

U.S. Pat. No. 4,792,147 to Wissing discloses a creeper having a molded body, sides thereof extending upwardly about a user's head and torso, and having removable wheels for permitting the body to be slid over rough and unstable terrain. The wheels, being typically 6 inches in diameter and having a width of 2 inches, are attached near the top of the sides and provide a nominal ground clearance of 1 inch when mounted. Larger wheels can be substituted. The creeper of Wissing also has significant disadvantages:

1. There is insufficient ground clearance for rolling over uneven and/or soft terrain with the standard wheels;

2. It is awkward to use in that the high, closely fitting sides impair movement and vision of a user, and the user must get off, remove, and store the wheels when encountering terrain unsuitable for rolling on the wheels;
3. Substitution of larger wheels makes the creeper ineffective for use where clearance is limited, requires separate storage of one or both sets of wheels, and impairs maneuverability to the extent that there is interference between the wheels and the body; and
4. It is believed that the wheels are subject to becoming bogged down, failing to roll on sand.

Aside from the other disadvantages, it is believed that none of the prior art creepers provide effective rolling support on the wide variety of ground surfaces that are commonly encountered in restricted clearance working situations under vehicles, building structures and the like.

Thus there is a need for a creeper that is effective for use in confined spaces, without impairing a user's movement or vision, that is easy to use and maneuver without modification on a variety of surfaces from hard and smooth to soft and uneven.

SUMMARY

The present invention meets this need by providing a creeper having wheels that are particularly suited for rollingly supporting a worker on sand, gravel and the like as well as permitting easy maneuverability on hard, smooth surfaces. In one aspect of the invention, the creeper includes a body member having a platform portion for supporting a torso portion of the worker; at least three wheels rotatably mounted relative to the body for rolling contact with the ground surface whereby the body is movable by the worker over the ground surface without adverse contact therewith, each of the wheels having a circumferential outer rib having an outside diameter not less than approximately 5 inches and a rib width not greater than approximately 2 inches for smooth rolling contact with the ground surface when the ground surface is hard and flat; and a plurality of side ribs laterally extending on opposite sides of the outer rib, the side ribs collectively having a major diameter and a minor diameter, the major diameter being not greater than approximately 0.1 inch less than the outside diameter, each of the side ribs having a rib length from the outer rib to an end extremity of the side rib, the rib length being not less than approximately 1.5 inches for rotating engagement with the ground surface and buoyant support thereby when the ground surface is soft and unstable.

The major diameter can be not less than approximately 1 inch greater than the minor diameter. The outside diameter can be not less than approximately 1.5 inches greater than the minor diameter. Each side rib can have a convex crown contour extending from the major diameter, the crown contour having a crown radius $r_1$, a concave root contour extending from the minor diameter and having a root radius $r_2$, the sum of the crown and root radii being approximately half of a pitch spacing S of the side ribs, the spacing S being measured on a pitch diameter $d_p$ that is the average of the major and minor diameters.

The outside diameter can be approximately 6 inches, the major diameter being approximately 5.5 inches, and the minor diameter being approximately 4.1 inches. The side ribs can extend proximately to an outside width of the wheel, the outside width being not less than 5 inches. The rib width can be approximately 1.5 inches and the outside width is approximately 6 inches. Preferably at least two of the wheels are rotatably mounted on a common axis fixably located relative to the body, at least one other of the wheels being movably located for permitting steerage of the creeper.

The body member can be molded from a high-strength plastic material. Preferably the body member includes a fender portion extending over at least one of the wheels, the fender portion being sufficiently flexible for contacting that wheel when stepped on by the worker, whereby the wheel is held from rotation by the fender portion.

DRAWINGS

These and other features, aspects, and advantages of the present invention will become better understood with reference to the following description, appended claims, and accompanying drawings, where:

FIG. 1 is a left oblique elevational perspective view of an all-terrain creeper according to the present invention;

FIG. 2 is a plan view of the creeper of FIG. 1;

FIG. 3 is a fragmentary sectional rear end view of the creeper of FIG. 1;

FIG. 4 is a left side elevational view of a front portion of the creeper of FIG. 1;

FIG. 5 is a detail elevational view of a wheel portion of the creeper of FIG. 1;

DESCRIPTION

Figure 6:
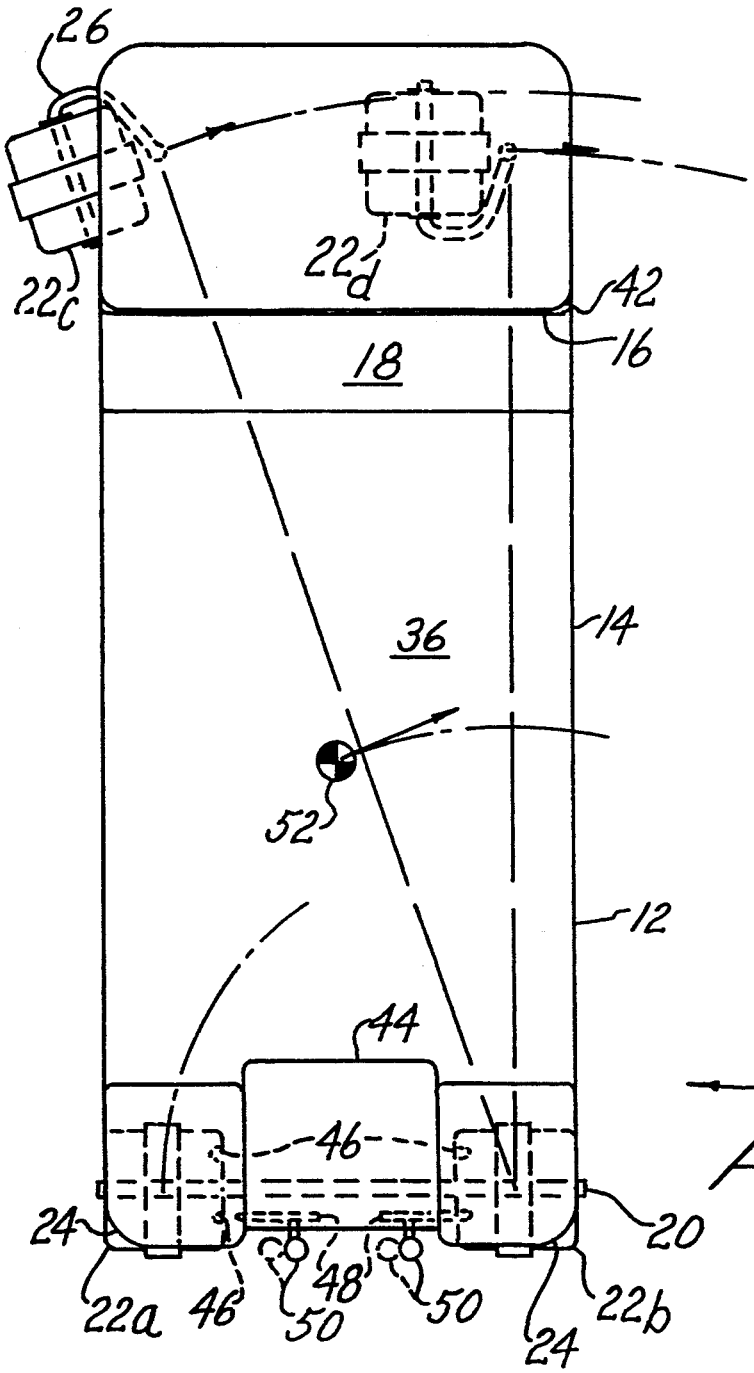
FIG. 6 is a plan diagrammatic view showing an alternative configuration of the creeper of FIG. 1.

The present invention is directed to a creeper that is particularly suited for negotiating a wide variety of challenging terrain, such as sand, gravel, dirt, fields, and carpeting, as well as hard, smooth surfaces, such as driveways and concrete floors. With reference to FIGS. 1–5 of the drawings, a creeper 10 has a platform or body 12 including a generally horizontally planar main portion 14 and an elevated front portion 16 connected thereto by a sloping ramp portion 18. A rigid rear axle 20 is fixedly mounted to the body 12 opposite the front portion 16, a pair of wheels 22, designated left rear wheel **22*a* and right rear wheel 22*b*, being rotatably mounted proximate opposite ends of the axle 20, outside extremities of the wheels 22*a* and 22*b* being approximately flush with respective sides of the body 12. The body 12 is formed to include a pair of fender members 24 for covering the rear wheels 22*a* and 22*b*. A pair of casters 26 are pivotally mounted under the front portion 16, each caster 26 having a rigid axle-frame 28, counterparts of the wheels 22, designated left front wheel 22*c* and right front wheel 22*d*, being rotatably mounted thereon for rollably supporting the creeper 10 on a ground surface 30. The body 12 has an overall width W and a length L, the casters 26 being spaced apart by a track T, at a distance B ahead of the axle 20**.

The wheels 22 are preferably identically configured for avoiding unnecessary tooling, production, and inventory costs. The configuration of the wheels 22 is preferably compatible with a generous ground clearance C above the ground surface 30.

According to the present invention, each of the wheels 22 is formed for enhanced support of the creeper 10 on a variety of surfaces that would otherwise preclude an occupant 31 of the creeper 10 from maneuvering under and about a vehicle or other object. Particularly, the wheels 22 are formed with a centrally located circumferential outer rib 32 having an outside diameter D, and a plurality of side ribs 34 extending laterally on opposite sides of the outer rib 32 approximately to an overall wheel width $W_1$ of the wheel 22. The outer rib 32 has a rib width $W_2$ that is less than half of the wheel width $W_1$. Collectively, the side ribs 34 have a major diameter $d_1$ and a minor diameter $d_2$, the major diameter $d_1$ being slightly smaller than the outside diameter D whereby, when the ground surface 30 is hard and flat (concrete or pavement), the outer rib 32 only contacts the ground surface 30 for facilitating movement and maneuvering thereon.

The side ribs 34 are preferably smoothly formed to achieve an undulating contour between the major and minor diameters $d_1$ and $d_2$. In a preferably exemplary configuration, the side ribs 34 have a crown radius $r_1$ and a root radius $r_2$, the crown and root radii $r_1$ and $r_2$ being approximately equal, the sum of the radii $r_1$ and $r_2$ being approximately half of a pitch spacing S of the side ribs 34, the spacing S being measured on a pitch diameter $d_p$ that is the average of the diameters $d_1$and $d_2$.

An experimental prototype of the creeper 10 has been built and tested, and various configurations have been used. As a result of experimentation, the above-described configuration of the wheels 22 has been adopted, with the outside diameter D being approximately 6 inches, eight of the side ribs 34 with the major diameter $d_1$ being approximately 5.5 inches, the minor diameter $d_2$ being approximately 4.12 inches, the width $W_1$ being approximately 6 inches, the width $W_2$ being approximately 1.5 inches, the crown radius $r_1$ being approximately 0.5 inch, and the root radius $r_2$ being approximately 0.45 inch.

In some of the experiments, the creeper 10 was equipped with three of the wheels 22 as described above, including the rear wheels **22*a* and 22*b*, but only one of the front wheels (22*c*), centrally located. The testing was done on grass, soft roadway shoulders, dry beach sand, under-home fill dirt, and ¾ inch gravel, with a desired degree of motion and maneuverability being attained. The average penetration in dry sand was approximately 2 inches. Based on the testing, it is desired that the outside diameter D be between 0.1 inch and 0.6 inch greater than the major diameter $d_1$ and at least 1.5 inches greater than the minor diameter $d_2$. Also the major diameter $d_1$ is preferably at least 1.4 inches greater than the minor diameter Further, the width $W_2$ should be at least 5 inches, preferably 6 inches, the side ribs 34 extending to the full width $W_2$ of the wheels 22**.

Preferably, there are four of the wheels 22 as described above, because as discovered in the testing, the three-wheeled configuration subjects the body 12 to large torsional loads during maneuvering in soft and/or rough terrain, which loads must be resisted by the user or by enhanced rigidity of the body 12 to avoid ground contact by the body 12. In a preferred configuration of the creeper 10 as shown in FIGS. 1–5, the body 12 is molded from a high-strength polymer (plastic) material, having a smooth top surface 36 for supporting a torso 38 of the occupant 31 on the main portion 14. Reinforcing rib members 40 extend opposite the top surface 36 as best shown in FIGS. 2 and 3, the body 12 generally having a thickness t as shown in FIG. 4. Thus the body 12 in the configuration of FIGS. 1–3, being formed with the thickness t approximately 2 inches, the width W approximately 20 inches and the length L approximately 42 inches, is believed to be sufficiently rigid for supporting the occupant 31 reclining thereon while working and/or maneuvering the creeper 10, the overall width W of the body 12 being approximately 20 inches, the length L being approximately 51 inches. Preferably the ground clearance C of the main portion 14 is approximately 3 inches for clearing uneven terrain without excessively elevating the occupant 31. Thus the creeper 10 is effective for maneuvering the occupant 31 the under an obstruction having an elevation of 17 inches with 12 inches between the obstruction and the main portion 14, the main portion 14 having a first height $H_1$ of approximately 5 inches.

As also shown in FIGS. 1 and 3, the fender members 24 extend generally horizontally above the rear wheels 22*a* and 22*b* in close proximity thereto, being sufficiently flexible for deflecting into contact therewith when stepped on by the occupant 31. Thus the occupant 31 can safely use the fenders 24 of the creeper 10 as steps for reaching elevated objects without being subjected to unwanted rolling of the creeper 10.

As further shown in FIGS. 1–4, the elevated front portion 16, having a second height $H_2$, has a first cushion 42 thereon, the cushion 42 defining an overall height H of the creeper 10. As second cushion 44 is fastened to the main portion 14 between the fender members 24, an upper surface of the second cushion 44 having a third height $H_3$ above the ground surface 30. As shown in FIG. 1, the occupant 31 can use the creeper 10 by reclining on the main portion 14 of the body 12, employing the second cushion 44 as a head rest and the first cushion 42 as a leg support. Maneuvering the creeper 10 can be effected by leg movements of the occupant 31 together with foot contact on the ground surface 30. Where vertical clearance is restricted, the leg movements can be done straddling the elevated front portion 16. If desired, the occupant 31 can assume a reverse position, using the first cushion 42 as a head rest, clearance permitting.

With further reference to FIG. 6, an alternative configuration of the creeper 10 provides enhanced movement control by selective locking of the rear wheels 22*a* and 22*b*. In the configuration of FIG. 6, the rear wheels 22*a* and 22*b* each have a circular array of lock discontinuities 46 formed therein, a pair of latch bolts 48 being movably mounted on the body 12 for selective engagement of one of the discontinuities 46 of a respective wheel 22 by a corresponding one of the bolts 48. Each of the bolts 48 has a handle 50 projecting therefrom for operation by the occupant 31, the bolts 48 being axially slidable in a direction parallel to the axle 20, the discontinuities 46 facing inwardly and being equally spaced from the axle 20 for alignment with the bolts 48. The discontinuities 46 can be formed by radial rib portions of the wheels 22, the latch bolts 48 engaging the rear wheels 22*a* and 22*b* by extending between the ribs.

As shown in FIG. 6, the right rear wheel 22*b* is locked by one of the bolts 48 such that movement of the creeper 10 is restricted to rotation about the wheel 22*b* for facilitating turning of the creeper 10. Particularly, the occupant can effect controlled turning about a selected one of the rear wheels 22*a* and 22*b* by locking that wheel and using leg movement (or by grabbing and pulling against a nearby stationary object) for effecting a turning moment about the wheel 22. FIG. 6 shows, for example, clockwise turning, the other wheels 22 and a center of gravity 52 of the occupant 31 moving in arcs about the right rear wheel 22*b*. It will be understood that turning is more difficult without the locking because force components that are not parallel to the rear axle 20 do not produce turning. If desired, the rear wheels 22*a* and 22*b* can be simultaneously locked for holding the creeper 10 in a fixed position on the ground surface 30, this feature being particularly advantageous on hard, smooth examples of the ground surface 30, especially if the ground surface 30 is not level.

Although the present invention has been described in considerable detail with reference to certain preferred versions thereof, other versions are possible. For example, the creeper 10 can have a motorized drive for selectively powering one or more of the wheels 20. Also, cargo strap kits may be provided for use of the creeper 10 as a transport vehicle. Therefore, the spirit and scope of the appended claims should not necessarily be limited to the description of the preferred versions contained herein.

What is claimed is:

1. A creeper for movably supporting a reclining worker in confined space on a ground surface, comprising:

(a) a body member having a platform portion for supporting a torso portion of the worker;

(b) at least three wheels rotatably mounted relative to the body member for rolling contact with the ground surface whereby the body member is movable by the worker over the ground surface without contact therewith, each of the wheels having:

(c) a circumferential outer rib having an outside diameter not less than approximately 5 inches and a rib width not greater than approximately 2 inches for smooth rolling contact with the ground surface when the ground surface is hard and flat; and (d) a plurality of side ribs laterally extending on opposite sides of the outer rib, the side ribs collectively having a major diameter and a minor diameter, the major diameter being not greater than approximately 0.1 inch less than the outside diameter, each of the side ribs having a rib length from the outer rib to an end extremity of the side rib, the rib length being not less than approximately 1.5 inches for rotating engagement with the ground surface and buoyant support thereby when the ground surface is soft and unstable.

2. The creeper of claim 1, wherein the major diameter is not less than approximately 1 inch greater than the minor diameter.

3. The creeper of claim 2, wherein the outside diameter is not less than approximately 1.5 inches greater than the minor diameter.

4. The creeper of claim 2, wherein each side rib has a convex crown contour extending from the major diameter, the crown contour having a crown radius $r_1$, a concave root contour extending from the minor diameter and having a root radius $r_2$, the sum of the crown and root radii being approximately half of a pitch spacing S of the side ribs, the spacing S being measured on a pitch diameter $d_p$ that is the average of the major and minor diameters.

5. The creeper of claim 1, wherein the outside diameter is approximately 6 inches, the major diameter is approximately 5.5 inches, and the minor diameter is approximately 4.1 inches.

6. The creeper of claim 1, wherein the side ribs extend proximately to an outside width of the wheel, the outside width being not less than 5 inches.

7. The creeper of claim 6, wherein the rib width is approximately 1.5 inches and the outside width is approximately 6 inches.

8. The creeper of claim 1, wherein at least two of the wheels are rotatably mounted on a common axis fixably located relative to the body member, at least one other of the wheels being movably located for permitting steerage of the creeper.

9. The creeper of claim 1, wherein the body member is molded from a high-strength plastic material.

10. The creeper of claim 9, wherein the body member includes a fender portion extending over at least one of the wheels, the fender portion being sufficiently flexible for contacting the at least one wheel when stepped on by the worker, whereby the wheel is held by the fender portion.

11. A creeper for movably supporting a reclining worker in confined space on a ground surface, comprising:

(a) a body member having a platform portion for supporting a torso portion of the worker;

(b) at least four wheels rotatably mounted relative to the body member for rolling contact with the ground surface whereby the body member is movable by the worker over the ground surface without contact therewith, at least one pair of the wheels being rotatably mounted on a common axis fixably located relative to the body member, another pair of the wheels being movably located for permitting steerage of the creeper, each of the wheels having:

(c) an circumferential outer rib having an outside diameter not less than approximately 5 inches and a rib width not greater than approximately 1.5 inches for smooth rolling contact with the ground surface when the ground surface is hard and flat;

(d) a plurality of side ribs laterally extending on opposite sides of the outer rib, the side ribs collectively having a major diameter and a minor diameter, the major diameter being not less than approximately 1.4 inches greater than the minor diameter, the outside diameter being between approximately 0.1 inch and 0.6 inch greater than the major diameter, the side ribs extending proximately to an outside width of the wheel, the outside width being not less than 5 inches, for rotating engagement with the ground surface and buoyant support thereby when the ground surface is soft and unstable, each side rib having a convex crown contour extending from the major diameter, the crown contour having a crown radius $r_1$, a concave root contour extending from the minor diameter and having a root radius $r_2$, the sum of the crown and root radii being approximately half of a pitch spacing S of the side ribs, the spacing S being measured on a pitch diameter $d_p$ that is the average of the major and minor diameters.

* * * * *